US010279596B2

(12) United States Patent
Okayama et al.

(10) Patent No.: US 10,279,596 B2
(45) Date of Patent: May 7, 2019

(54) THERMAL HEAD AND THERMAL PRINTER

(71) Applicant: KYOCERA Corporation, Kyoto-shi, Kyoto (JP)

(72) Inventors: Arata Okayama, Uji (JP); Hisatoshi Takada, Okaya (JP); Tatsuru Seto, Okaya (JP); Makoto Watanabe, Okaya (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 15/762,311

(22) PCT Filed: Sep. 26, 2016

(86) PCT No.: PCT/JP2016/078171
§ 371 (c)(1),
(2) Date: Mar. 22, 2018

(87) PCT Pub. No.: WO2017/051919
PCT Pub. Date: Mar. 30, 2017

(65) Prior Publication Data

US 2018/0281451 A1 Oct. 4, 2018

(30) Foreign Application Priority Data

Sep. 26, 2015 (JP) ..... 2015-189044

(51) Int. Cl.
*B41J 2/335* (2006.01)
*B41J 2/345* (2006.01)

(52) U.S. Cl.
CPC ..... *B41J 2/3352* (2013.01); *B41J 2/3351* (2013.01); *B41J 2/3354* (2013.01); *B41J 2/3357* (2013.01); *B41J 2/33515* (2013.01); *B41J 2/345* (2013.01)

(58) Field of Classification Search
CPC ..... H01L 2924/181; H01L 2224/8592; H01L 23/3135; H01L 23/315; B41J 2/3359; H05K 3/284
See application file for complete search history.

(56) References Cited

U.S. PATENT DOCUMENTS 7,414,641 B2 * 8/2008 Sasaki ..... B41J 2/3359 347/205
2007/0146468 A1 6/2007 Sasaki et al.
(Continued)

FOREIGN PATENT DOCUMENTS

CN 104812584 A 7/2015
JP 62-185342 A 8/1987
(Continued)

OTHER PUBLICATIONS

Computer-generated translation of JP 2003-220723, published on Aug. 2003.*
(Continued)

*Primary Examiner* — Huan H Tran
(74) *Attorney, Agent, or Firm* — Volpe and Koenig, P.C.

(57) ABSTRACT

A thermal head includes: a substrate; a heat generating section which is disposed on the substrate; a plurality of driving ICs including first and second driving ICs which are disposed on the substrate and electrically coupled to the heat generating section; and a cover member covering the first and second driving ICs. The cover member is disposed in an inter-driving IC region between the first driving IC and the second driving IC and above and below the inter-driving IC region, and includes a first void.

7 Claims, 6 Drawing Sheets

(56) References Cited

U.S. PATENT DOCUMENTS

| | | | | |
|---|---|---|---|---|
| 2016/0339716 | A1* | 11/2016 | Yoneta | B41J 2/3351 |
| 2018/0201026 | A1* | 7/2018 | Matsusaki | B41J 2/32 |

FOREIGN PATENT DOCUMENTS

| | | | |
|---|---|---|---|
| JP | 63-079353 | A | 4/1988 |
| JP | 02-144947 | A | 6/1990 |
| JP | 11-026654 | A | 1/1999 |
| JP | 2003-220723 | A | 8/2003 |
| JP | 2007-175981 | A | 7/2007 |
| JP | 2014-188682 | A | 10/2014 |
| WO | 2015/029913 | A1 | 3/2015 |

OTHER PUBLICATIONS

International Search Report, PCT/JP2016/078171, dated Nov. 29, 2016, 2 pgs.

* cited by examiner

THERMAL HEAD AND THERMAL PRINTER

TECHNICAL FIELD

The present invention relates to a thermal head and a thermal printer.

BACKGROUND ART

In the related art, various thermal heads have been proposed as printing devices such as facsimiles or video printers. For example, a thermal head including a substrate, a heat generating section disposed on the substrate, driving ICs (integrated circuits) which are disposed on the substrate to control driving of the heat generating section, and a cover member covering the plurality of driving ICs has been known (see Patent Literature 1).

CITATION LIST

Patent Literature

Patent Literature 1: Japanese Unexamined Patent Publication JP-A 2007-175981

SUMMARY OF INVENTION

A thermal head according to the present disclosure includes: a substrate; a heat generating section which is disposed on the substrate; a plurality of driving ICs which are disposed on the substrate to control driving of the heat generating section; and a cover member covering the plurality of driving ICs. The cover member includes first portions extending over inter-driving IC regions between mutually adjacent driving ICs and extending up and down from the inter-driving IC regions, second portions extending below the driving ICs, and third portions extending above the driving ICs. first voids are formed in the first portions.

A thermal printer according to the present disclosure includes: the thermal head mentioned above; a conveyance mechanism which conveys a recording medium on the heat generating section; and a platen roller which presses the recording medium against a top of the heat generating section.

BRIEF DESCRIPTION OF DRAWINGS

FIGS. 4A and 4B show the thermal head illustrated in FIG. 1, wherein FIG. 4A is a schematic plan view, and FIG. 4B is a sectional view taken along the line IVb-IVb illustrated in FIG. 4A;

FIGS. 6A and 6B show a thermal head according to a second embodiment, wherein FIG. 6A is a schematic plan view and FIG. 6B is a sectional view taken along the line VIb-VIb illustrated in FIG. 6A.

DESCRIPTION OF EMBODIMENTS

Figure 1:
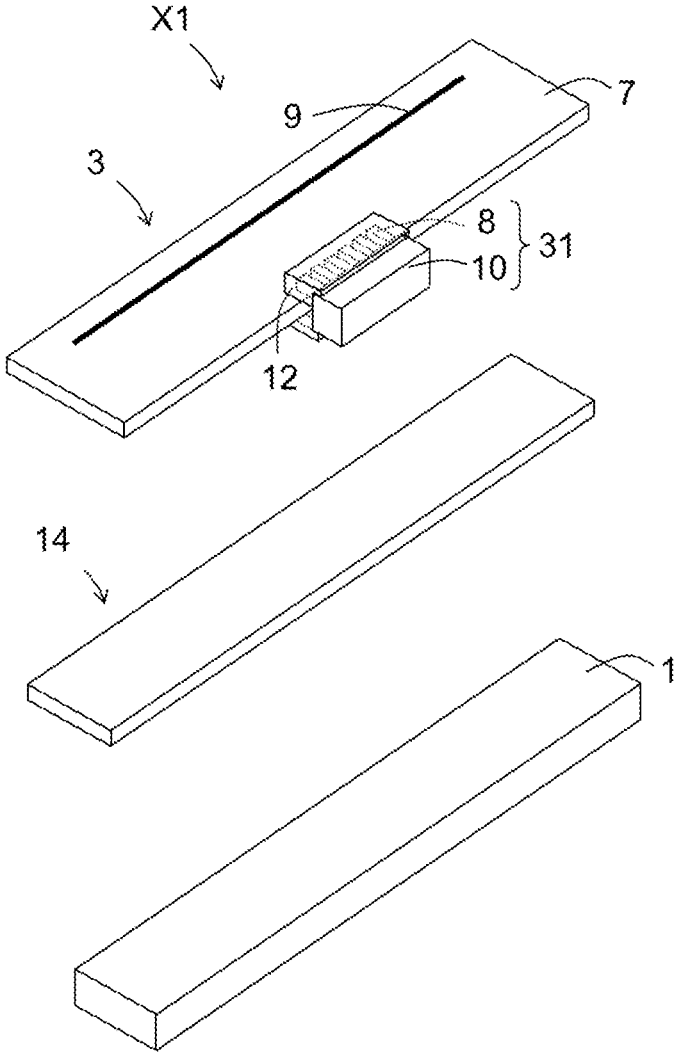
FIG. 1 is an exploded perspective view illustrating an outline of a thermal head according to a first embodiment.

Hereinafter, embodiments will be described with reference to the drawings. The drawings to be described below are schematic, and dimensions, scales, and the like in the drawings do not necessarily match actual dimensions, scales, and the like. Even in the plurality of drawings illustrating the same members, dimensions, scales, and the like do not match each other to exaggerate the shapes or the like in some cases.

First Embodiment

Figure 2:
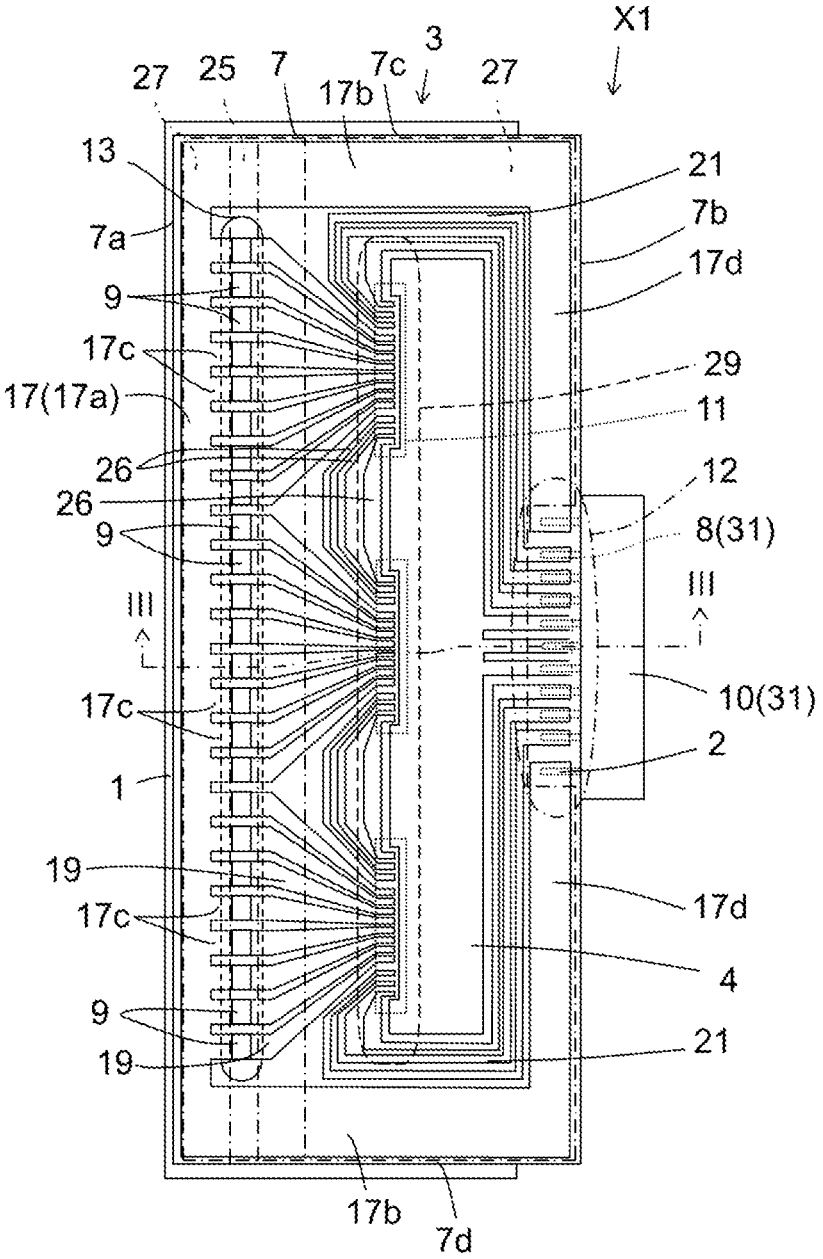
FIG. 2 is a plan view illustrating the thermal head illustrated in FIG. 1.

Hereinafter, a thermal head X1 will be described with reference to FIGS. 1 to 4B. FIG. 1 schematically illustrates a configuration of the thermal head X1. In FIG. 2, a protective layer 25, a cover layer 27, and a sealing member 12 are indicated by one-dot chain lines. In FIG. 4A, only a driving IC 11 and a cover member 29 are illustrated among members disposed on a substrate 7.

The thermal head X1 includes a head base body 3, a connector 31, a sealing member 12, a heat dissipating plate 1, and an adhesive layer 14. In the thermal head X1, the head base body 3 is placed on the heat dissipating plate 1 with the adhesive layer 14 interposed therebetween. The head base body 3 is configured so that the heat generating section 9 is provided on the substrate 7. When a voltage is applied from the outside, the heat generating section 9 generates heat to perform printing on a recording medium (not illustrated). The connector 31 electrically connects the head base body 3 to the outside. The sealing member 12 joins the connector 31 to the head base body 3. The heat dissipating plate 1 is formed to cool the heat of the head base body 3. The adhesive layer 14 bonds the head base body 3 to the heat dissipating plate 1.

The heat dissipating plate 1 is formed in a rectangular shape, and the substrate 7 is placed on the heat dissipating plate 1. The heat dissipating plate 1 is formed of, for example, a metal material such as copper, iron, or aluminum. The heat dissipating plate 1 dissipates part of the heat the heat evolved in the heat generating section 9 of the head base body 3 which part is not conducive to printing.

The head base body 3 is formed in a rectangular shape in a plan view. In the head base body 3, each member forming the thermal head X1 is provided on the substrate 7. The head base body 3 performs printing on a recording medium (not illustrated) in accordance with an electric signal supplied from the outside.

Hereinafter, members constituting the head base body 3 will be described.

The substrate 7 is disposed on the heat dissipating plate 1 and is formed in a rectangular shape in a plan view. Therefore, the substrate 7 includes a first long side 7*a*, a second long side 7*b*, a first short side 7*c*, and a second short side 7*d*. The substrate 7 is formed of, for example, an electrically insulating material such as alumina ceramics or a semiconductor material such as a monocrystalline silicon.

A heat storage layer 13 is disposed on the substrate 7. The heat storage layer 13 protrudes from the substrate 7 upward. The heat storage layer 13 extends in a belt shape in an arrangement direction of the plurality of heat generating sections 9, and has a substantially semi-elliptical sectional profile. A height of the heat storage layer 13 from the substrate 7 is set to 15 to 90 μm.

The heat storage layer 13 is formed of glass having a low thermal conductivity, and temporarily stores part of the heat evolved in the heat generating section 9. Hence, the heat storage layer 13 shortens the time required to raise the temperature of the heat generating section 9, and thus functions to improve the thermal response characteristics of the thermal head X1. For example, the heat storage layer 13 is formed by applying a predetermined glass paste to the upper surface of the substrate 7 by heretofore known technique such as screen printing, and thereafter firing the glass paste.

An electrical resistance layer 15 is located on the upper surface of the substrate 7, as well as on an upper surface of the heat storage layer 13. On the electrical resistance layer 15, various types of electrodes constituting the head base body 3 are disposed. The electrical resistance layer 15 is patterned in the same configuration as that of each electrode constituting the head base body 3, and has exposed regions, each of which is an exposed electrical-resistance layer 15 region lying between a common electrode 17 and a discrete electrode 19. The exposed regions constitute the heat generating sections 9, and are arranged with predetermined spacing in array form on the heat storage layer 13.

The plurality of heat generating sections 9, while being illustrated in simplified form in FIG. 2 for convenience in explanation, are arranged at a density of 100 dpi (dot per inch) to 2400 dpi, for example. The electrical resistance layer 15 is formed of a material having a relatively high electrical resistance value such for example as a TaN-based material, a TaSiO-based material, a TaSiNO-based material, a TiSiO-based material, a TiSiCO-based material, or a NbSiO-based material. Hence, upon application of a voltage to the heat generating section 9, the heat generating section 9 generates heat under Joule heating effect.

The common electrode 17 electrically connects the plurality of heat generating sections 9 to the connector 31. The common electrode 17 comprises: main wiring portions 17*a* and 17*d*; sub wiring portions 17*b*; and lead portions 17*c*. The main wiring portion 17*a* extends along the first long side 7*a* of the substrate 7. The sub wiring portions 17*b* extend along the first short side 7*c* and the second short side 7*d*, respectively, of the substrate 7. The lead portions 17*c* extend from the main wiring portion 17*a* toward the corresponding heat generating sections 9 on an individual basis. The main wiring portion 17*d* extends along the second long side 7*b* of the substrate 7.

The plurality of discrete electrodes 19 provide electrical connection between the heat generating section 9 and a driving IC 11. Moreover, the discrete electrodes 19 allow the plurality of heat generating sections 9 to fall into a plurality of groups, and provide electrical connection between each heat generating section 9 group and corresponding one of the driving ICs 11 assigned one to each group.

A plurality of IC-connector connection electrodes 21 provides electrical connection between the driving IC 11 and the connector 31. The plurality of IC-connector connection electrodes 21 connected to the corresponding driving ICs 11 are composed of a plurality of wiring lines having different functions.

A ground electrode 4 is maintained at a ground potential of 0 V to 1 V. The ground electrode 4 is located so as to be surrounded by the discrete electrode 19, the IC-connector connection electrode 21, and the main wiring portion 17*d* of the common electrode 17.

Connection terminals 2 of the head base body 3 connect the common electrode 17, the discrete electrode 19, the IC-connector connection electrode 21 and the ground electrode 4 to the connector 31. A plurality of connection terminals 2 are located in the main scanning direction on the second long side 7*b* side of the substrate 7. The connection terminals 2 are disposed corresponding to connector pins 8 of the connector 31.

A plurality of IC-IC connection electrodes 26 electrically connects adjacent driving ICs 11. The plurality of IC-IC connection electrodes 26 are each disposed corresponding to the IC-connector connection electrode 21 and transmit various signals to the adjacent driving ICs 11.

Various electrodes constituting the head base body 3 described above are formed by the following procedure, for example. Layers of materials which constitute the various electrodes are laminated one after another on the heat storage layer 13 and on the substrate 7 by thin-film forming technique such as sputtering. Next, the laminate body is worked into predetermined patterns by heretofore known technique such as photoetching to form the various electrodes. The various electrodes constituting the head base body 3 may be formed at one time through the same procedural steps.

As shown in FIG. 2, the driving IC 11 is disposed corresponding to each group of the plurality of heat generating sections 9. The driving IC 11 is connected to the discrete electrode 19 and the IC-connector connection electrode 21 or the ground electrode 4. The driving IC 11 functions to control the current-carrying condition of each heat generating section 9. As the driving IC 11, for example, a switching member having a plurality of built-in switching elements is used.

The driving IC 11, while being connected to the discrete electrode 19, the IC-IC connection electrode 26, and the IC-connector connection electrode 21, is sealed with a cover member 29.

Figure 3:
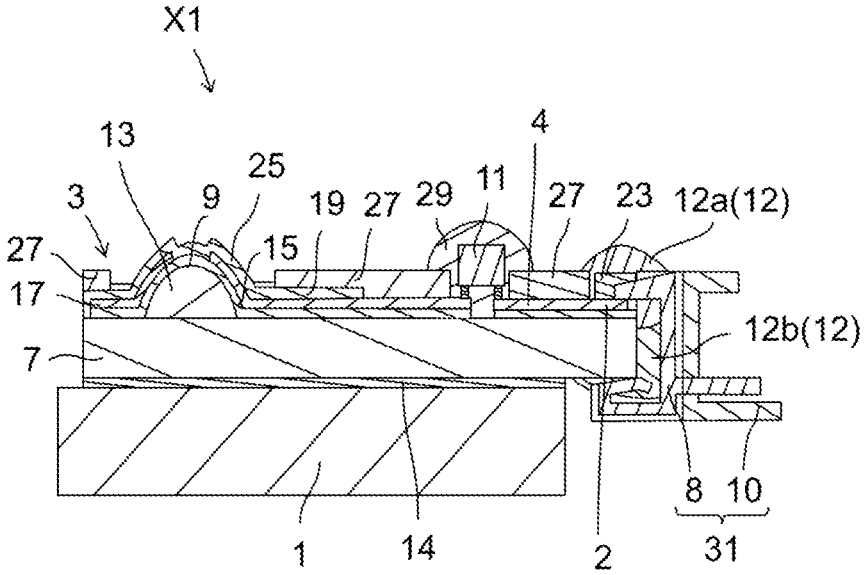
FIG. 3 is a sectional view taken along the line III-III illustrated in FIG. 2.
Figure 4A:
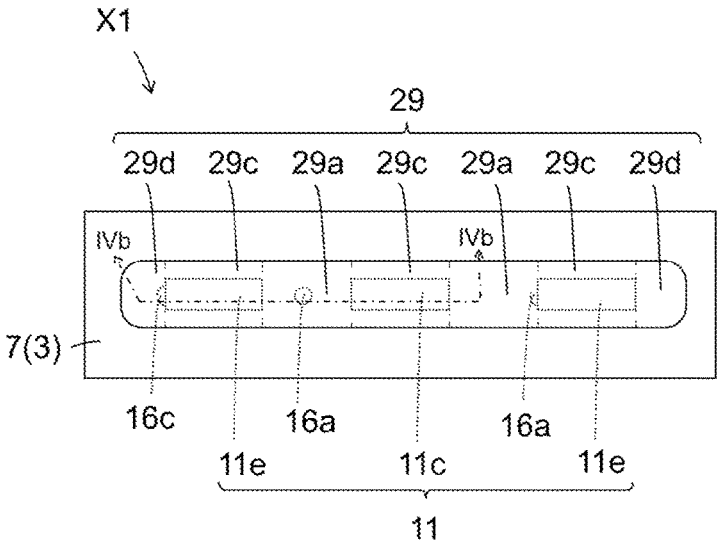

As illustrated in FIGS. 2 and 3, the protective layer 25 cover the heat generating sections 9, a part of the common electrode 17, and parts of the discrete electrodes 19 is formed on the heat storage layer 13.

The protective layer 25 protects the heat generating section 9 and the covered areas of the common electrode 17 and the discrete electrode 19 against corrosion caused by adhesion of atmospheric water content, etc., or against wear caused by contact with a recording medium under printing. The protective layer 25 may be formed of an inorganic material such as SiN, $SiO_2$, SiON, SiC, or diamond-like carbon. The protective layer 25 may be formed of a single layer or may be formed by stacking such layers. The protective layer 25 may be produced by thin-film forming technique such as sputtering, or thick-film forming technique such as screen printing.

As illustrated in FIGS. 2 and 3, on the substrate 7, there is provided a cover layer 27 which partly covers the common electrode 17, the discrete electrode 19, and the IC-connector connection electrode 21. The cover layer 27 protects the covered areas of the common electrode 17, the discrete electrode 19, the IC-IC connection electrode 26, and the IC-connector connection electrode 21 against oxidation caused by exposure to air, or corrosion caused by adhesion of atmospheric water content, etc.

The connector 31 and the head base body 3 are secured to each other via the connector pin 8, a conductive joining member 23, and the sealing member 12. The conductive joining member 23 is disposed between the connection terminal 2 and the connector pin 8, and the conductive joining member 23 connects the connection terminal 2 and the connector pin 8. Exemplary of the conductive joining member 23 is a solder bump or an anisotropic conductive adhesive.

Note that a Ni-, Au-, or Pd-plating layer (not shown in the drawings) may be interposed between the conductive joining member 23 and the connection terminal 2. The conductive joining member 23 does not necessarily have to be provided.

In this case, the connection terminal 2 and the connector pin 8 may be electrically connected using a clip type connector pin 8.

The connector 31 comprises the plurality of connector pins 8 and a housing 10. Each of the plurality of connector pins 8 is disposed on the connection terminal 2 of the head base body 3, and electrically connects the connector 31 and the head base body 3. The housing 10 receives the plurality of connector pins 8. The sealing member 12 is disposed on the connector pins 8 so that the connector pins 8 are not exposed.

The sealing member 12 comprises a first sealing member 12*a* and a second sealing member 12*b*. The first sealing member 12*a* is located on the upper surface of the substrate 7. The first sealing member 12*a* is disposed so as to seal a connection portion between the connector pin 8 and the various electrodes. The second sealing member 12*b* is located on a lower surface of the substrate 7. The second sealing member 12*b* is disposed so as to seal the connector pin 8.

The sealing member 12 is disposed so as not to expose the connection terminal 2 and the connector pin 8 to the outside. The sealing member 12 may be formed of a thermosetting epoxy resin, an ultraviolet-curable resin, or a visible light-curable resin, for example. The first sealing member 12*a* and the second sealing member 12*b* may be formed either of the same material or of different materials.

The adhesive layer 14 is placed on an upper surface of the heat dissipating plate 1 to bond the head base body 3 and the heat dissipating plate 1. Exemplary of the adhesive layer 14 is a double-faced tape or a resin-based adhesive.

Figure 4B:
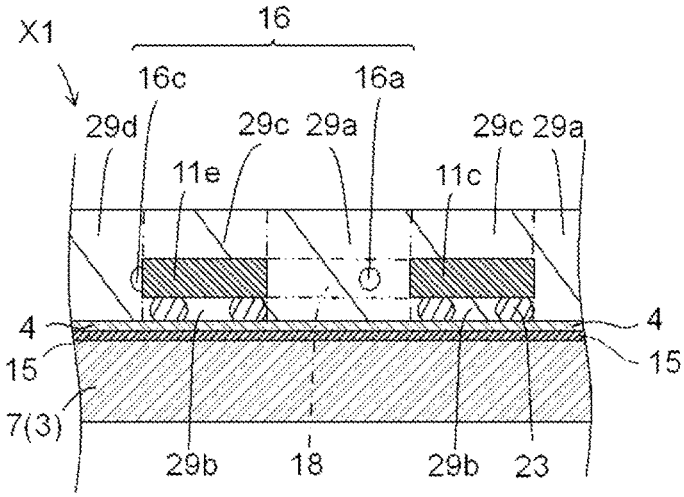

The cover member 29 and voids 16 formed inside the cover member 29 will be described in detail with reference to FIGS. 4A and 4B.

As illustrated in FIG. 4A, the plurality of driving ICs 11 are arranged at intervals in the main scanning direction. The cover member 29 is disposed on the plurality of driving ICs 11. The cover member 29 covers the plurality of driving ICs 11.

The cover member 29 includes a first portion 29*a*, a second portion 29*b*, a third portion 29*c*, and a fourth portion 29*d*. The first portion 29*a* is a portion extending over each of the inter-driving IC regions 18 between the mutually adjacent driving ICs 11 and extending us and down from each of the inter-driving IC regions 18. The second portion 29*b* is a portion extending below the driving IC 11. The second portion 29*b* is specifically disposed between the lower surface of the driving IC 11 and the electrode 4. The third portion 29*c* is a portion extending above the driving IC 11. The fourth portion 29*d* is a portion located on both sides in the main scanning direction of the driving IC 11 group constituted by the plurality of driving ICs 11. In FIGS. 4A and 4B, boundaries between the first portion 29*a*, the second portion 29*b*, the third portion 29*c*, and the fourth portion 29*d* are indicated by two-dot chain lines. Actually, the first portion 29*a*, the second portion 29*b*, the third portion 29*c*, and the fourth portion 29*d* are continuously provided. For example, the cover member 29 can be continuously manufactured so that a hardening resin is applied astride the plurality of driving ICs 11 by a dispenser.

The cover member 29 can be formed of a resin such as an epoxy resin or a silicon resin.

The voids 16 are formed inside the cover member 29. A first void 16*a* and a third void 16*c* are formed in the cover member 29. The first void 16*a* is formed in the first portion 29*a*. The third void 16*c* is formed in the fourth portion 29*d*. The first void 16*a* and the third void 16*c* are formed inside the cover member 29 so as not to communicate with the outside.

The first void 16*a* is formed in the first portion 29*a* and is disposed in a state of being separated from the head base body 3. That is, as illustrated in FIGS. 4A and 4B, the driving ICs 11 include driving ICs 11*e* on both ends in the main scanning direction and a driving IC 11*c* between the driving ICs 11*e*. The first void 16*a* is located between the left-end driving IC 11*e* and the middle driving IC 11*c* and is in contact with a side surface of the right-end driving IC 11*e*. The first void 16*a* is located above the ground electrode 4 constituting the head base body 3.

The third void 16*c* is formed in the fourth portion 29*d* and is disposed in a state of being separated from the head base body 3. The third void 16*c* is formed in a state of being in contact with the driving IC 11*e* located on the left end in the main scanning direction. That is, as illustrated in FIG. 4B, the third void 16*c* is in contact with the side surface of the driving IC 11*e* located at the end in a state of being separated from the head base body 3. In other words, the third void 16*c* confronts the left-end driving IC 11*e*.

In the case where the first void 16*a* and the third void 16*c* are formed in a substantially circular shape in a sectional view, the diameters of the first void 16*a* and the third void 16*c* can be set to be 10 to 5000 μm. The diameters of the first void 16*a* and the third void 16*c* can be determined by cutting the cover member 29 vertically and measuring the diameters of the voids appearing on the cross sections. The first void 16*a* and the third void 16*c* may not be formed in the circular shape.

Here, the thermal head X1 performs printing by supplying a voltage to the driving ICs 11 from the connector 31 (see FIG. 2) and causing the driving ICs 11 to drive the heat generating sections 9 (see FIG. 2). When the driving ICs 11 are driven to process the electric signal, the driving ICs 11 generates heat, and thus the heat is transferred to the first portion 29*a*, the second portion 29*b*, the third portion 29*c*, and the fourth portion 29*d* located around the driving ICs 11. When the portions are thermally expanded by the transferred heat, the first portion 29*a* interposed between the second portion 29*b* and the third portion 29*c* is compressed from both sides. As a result, compression stress is concentrated on the first portion 29*a*, the first portion 29*a* is damaged, the sealing property of the driving ICs 11 deteriorates, and thus there is a concern that a failure occurs in the driving ICs 11.

In particular, since high-definition printing is recently required, a processing amount of the electric signal of the driving ICs 11 increases with an increase with high resolution of the thermal head X1, and thus the driving ICs 11 are easily heated to high temperature. Therefore, the cover member 29 located around the driving ICs 11 is likely to thermally expand, and thus the first portion 29*a* is easily damaged.

On the other hand, when the first void 16*a* is formed in the first portion 29*a*, the compression stress acting on the first portion 29*a* is moderated because of deformation of the first void 16*a* even though the second portion 29*b* and the third portion 29*c* thermally expand and the compression stress occurs in the first portion 29*a*. Thus, since the cover member 29 is less likely to be damaged and the sealing property of the driving ICs 11 can be maintained, a failure is less likely to occur in the driving ICs 11.

When the driving of the driving ICs 11 stops or the processing amount of the electric signal of the driving ICs 11 decreases, an amount of heat generated in the driving ICs 11 decreases. At this time, the heat transferred to the cover member 29 is released to the outside, and the temperature of the cover member 29 is gradually lowered. Thus, the thermally expanding cover member 29 is contracted as the temperature is lowered. As a result, the first portion 29*a* sandwiched between the second portion 29*b* and the third portion 29*c* is pulled from both sides, tensile stress is concentrated on the first portion 29*a*, and thus there is a concern that the first portion 29*a* is damaged. As a result, the sealing property of the driving ICs 11 deteriorates, and thus there is a concern that a failure occurs in the driving ICs 11.

On the other hand, when the first void 16*a* is formed in the first portion 29*a*, the tensile stress acting on the first portion 29*a* is moderated because of deformation of the first void 16*a* even though the second portion 29*b* and the third portion 29*c* contract and the tensile stress occurs in the first portion 29*a*. Thus, since the cover member 29 is less likely to be damaged and the sealing property of the driving ICs 11 can be maintained, a failure is less likely to occur in the driving ICs 11.

Since both ends of the cover member 29 located in the inter-driving IC region 18 are fixed to the driving ICs 11, a compression stress is concentrated from the driving ICs 11 to the inter-driving IC region 18 at the time of thermal expansion, and a tensile stress is likely to be concentrated at the time of contraction by cooling. As a result, the cover member 29 of the inter-driving IC region 18 is damaged, the sealing property of the driving ICs 11 deteriorates, and there is a concern that a failure occurs in the driving ICs 11.

On the other hand, since the first void 16*a* is located in the inter-driving IC region 18, the compression stress or the tensile stress can be moderated because of deformation of the first void 16*a* even though the cover member 18 of the inter-driving IC region 18 thermally expands or is cooled to contract, and thus the cover member 29 is less likely to be damaged. Thus, since the sealing property of the driving ICs 11 can be maintained, a failure is less likely to occur in the driving ICs 11.

The first void 16*a* is in contact with the driving IC 11. In other words, the first void 16*a* confronts the driving IC 11. Thus, thermal conduction to the first portion 29*a* is suppressed. As a result, the heat generated in the driving ICs 11 is less likely to be transferred to the first portion 29*a*, and thus the first portion 29*a* is less likely to thermally expand. Therefore, it is possible to suppress the concentration of the compression stress on the first portion 29*a*, and thus the cover member is less likely to be damaged. Thus, the sealing property of the driving ICs 11 can be maintained, and thus a failure is less likely to occur in the driving ICs 11.

The third void 16*c* is formed in the fourth portion 29*d* of the cover member 29 at an end in the main scanning direction of the driving IC 11 group. Thus, it is possible to suppress transfer of the heat of the driving IC 11*e* provided at the end in the main scanning direction from the fourth portion 29*d* to the outside. As a result, it is possible to suppress release of heat from the fourth portion 29*d* to the outside, and thus the temperature of the thermal head X1 at the end in the main scanning direction is less likely to be reduced. Therefore, it is possible to reduce a variation in the temperature in the main scanning direction of the thermal head X1.

The third void 16*c* is in contact with the driving IC 11. In other words, the third void 16*c* confronts the driving IC 11. As a result, thermal conduction to the fourth portion 29*d* is suppressed. Thus, the heat generated in the driving IC 11 is less likely to be transferred to the fourth portion 29*d*, and thus it is possible to suppress the thermal expansion of the fourth portion 29*d*. Therefore, it is possible to prevent compression stress from being concentrated on the fourth portion 29*d*, and thus the cover member 29 is less likely to be damaged. Thus, the sealing property of the driving ICs 11 can be maintained, and thus a failure is less likely to occur in the driving ICs 11.

Further, the first void 16*a* and the third void 16*c* are formed in a state of being separated from the ground electrode 4 of the head base body 3 and do not communicate with the outside. Thus, it is possible to reduce a possibility that a liquid or the like enters from the outside via the first void 16*a* and the third void 16*c*, and thus it is possible to improve reliability of the thermal head X1.

Since the third void 29*c* has no void 16, the strength of the third portion 29*c* is less likely to be reduced. Therefore, even when a recording medium P comes into contact with the third portion 29*c*, the third portion 29*c* is less likely to be damaged, and thus it is possible to reduce a possibility that the cover member 29 is damaged.

The example in which the first void 16*a* and the third void 16*c* are in contact with the driving ICs 11 is described, but may not be in contact with the driving ICs 11. In this case, the first void 16*a* can alleviate the stress of the first portion 29*a* and the third void 16 can reduce a possibility that the heat is transferred to the fourth portion 29*d*. The plurality of first voids 16*a* and the plurality of third voids 16*c* may be formed.

Further, air may be filled inside the voids 16. That is, the voids 16 may be constituted by air bubbles. In this case, the air filled inside the voids 16 improves a heat insulation property.

The thermal head X1 can be manufactured according to the following method, for example. When the cover member 29 is formed of a two-liquid type thermosetting resin, there is used a resin in which viscosities of a base compound and a curing agent are set to be high and the base compound and the curing agent are stirred in the state in which the viscosities are high. Thus, the cover member 29 containing the voids 16 can be formed.

The voids 16 may be formed to be contained in the cover member 29 while applying a foaming agent to the surface of the driving ICs 11 and bringing the voids 16 to come into contact with the driving ICs 11. For example, by covering the driving ICs 11 with the cover member 29 in a state in which an organic solvent with a low boiling point is applied to the surface of the driving ICs 11 and heating the cover member 29, the voids 16 may be formed inside the cover member 29. The voids 16 in contact with the driving ICs 11 may be generated by processing the surface of the driving ICs 11.

Next, a thermal printer Z1 will be described with reference to FIG. 5.

Figure 5:
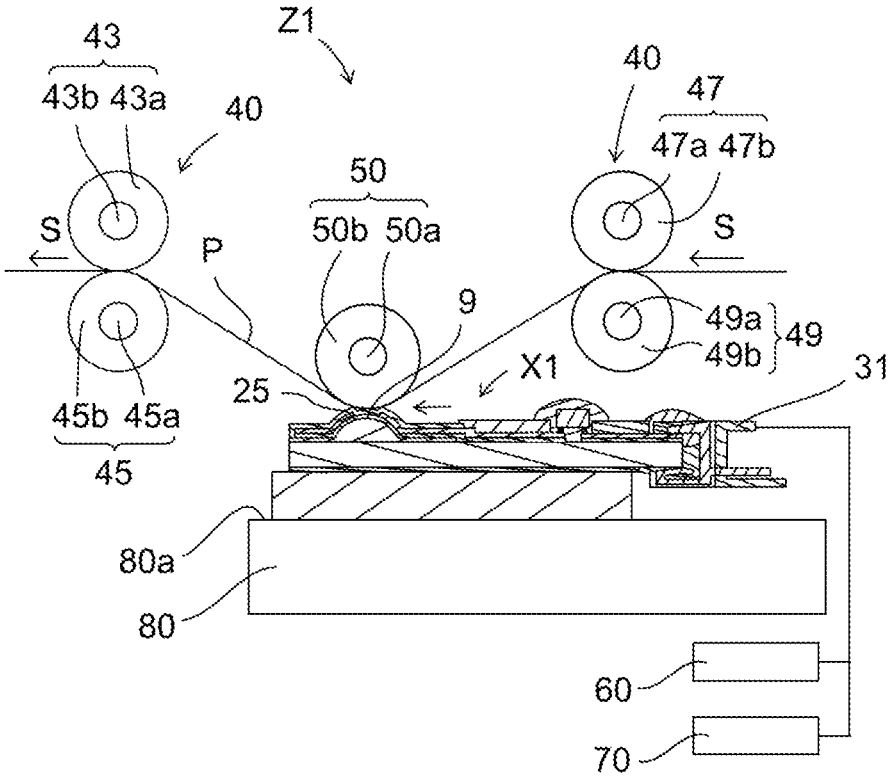
FIG. 5 is a schematic view illustrating a thermal printer according to the first embodiment.

As illustrated in FIG. 5, the thermal printer Z1 according to the embodiment comprises: the thermal head X1 described above; a conveyance mechanism 40; a platen roller 50; a power supply device 60; and a control unit 70. The thermal head X1 is attached to a mounting face 80*a* of a mounting member 80 disposed in a housing (not shown) for the thermal printer Z1. The thermal head X1 is mounted on the mounting member 80 so as to be oriented along the main scanning direction which is perpendicular to a conveying direction S of the recording medium P which will hereafter be described.

The conveyance mechanism 40 comprises a driving section (not shown) and conveying rollers 43, 45, 47 and 49. The conveyance mechanism 40 serves to convey the recording medium P such as thermal paper or ink-transferable image-receiving paper, in a direction indicated by the arrow S shown in FIG. 5 so as to move the recording medium P onto the protective layer 25 located on the plurality of heat generating sections 9 of the thermal head X1. The driving section functions to drive the conveying rollers 43, 45, 47 and 49, and, for example, a motor may be used for the driving section. For example, the conveying roller 43, 45, 47, 49 is composed of a cylindrical shaft body 43*a*, 45*a*, 47*a*, 49*a* formed of metal such as stainless steel covered with an elastic member 43*b*, 45*b*, 47*b*, 49*b* formed of butadiene rubber, for example. Although not shown in the drawing, when using ink-transferable image-receiving paper or the like as the recording medium P, the recording medium P is conveyed together with an ink film which lies between the recording medium P and the heat generating section 9 of the thermal head X1.

The platen roller 50 functions to press the recording medium P against the top of the protective layer 25 located on the heat generating section 9 of the thermal head X1. The platen roller 50 is disposed so as to extend along a direction perpendicular to the conveying direction S of the recording medium P, and is fixedly supported at ends thereof so as to be rotatable while pressing the recording medium P against the top of the heat generating section 9. For example, the platen roller 50 may be composed of a cylindrical shaft body 50*a* formed of metal such as stainless steel covered with an elastic member 50*b* formed of butadiene rubber, for example.

The power supply device 60 functions to supply electric current for enabling the heat generating section 9 of the thermal head X1 to generate heat as described above, as well as electric current for operating the driving IC 11. The control unit 70 functions to feed a control signal for controlling the operation of the driving IC 11 to the driving IC 11 in order to cause the heat generating sections 9 of the thermal head X1 to selectively generate heat as described above.

As illustrated in FIG. 5, the thermal printer Z1 performs predetermined printing on the recording medium P by, while pressing the recording medium P against the top of the heat generating section 9 of the thermal head X1 by the platen roller 50, conveying the recording medium P onto the heat generating section 9 by the conveyance mechanism 40, and also operating the power supply device 60 and the control unit 70 so as to enable the heat generating sections 9 to selectively generate heat. When using image-receiving paper or the like as the recording medium P, printing on the recording medium P is performed by thermally transferring the ink of the ink film (not shown), which is conveyed together with the recording medium P, onto the recording medium P.

Second Embodiment

Figure 6A:
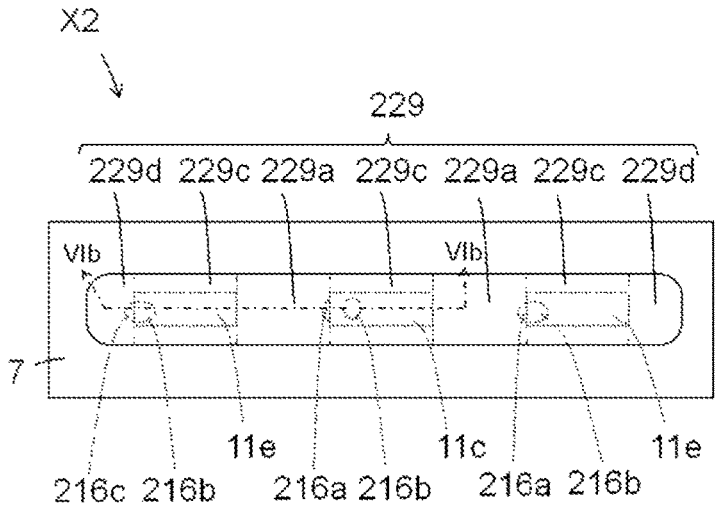
Figure 6B:
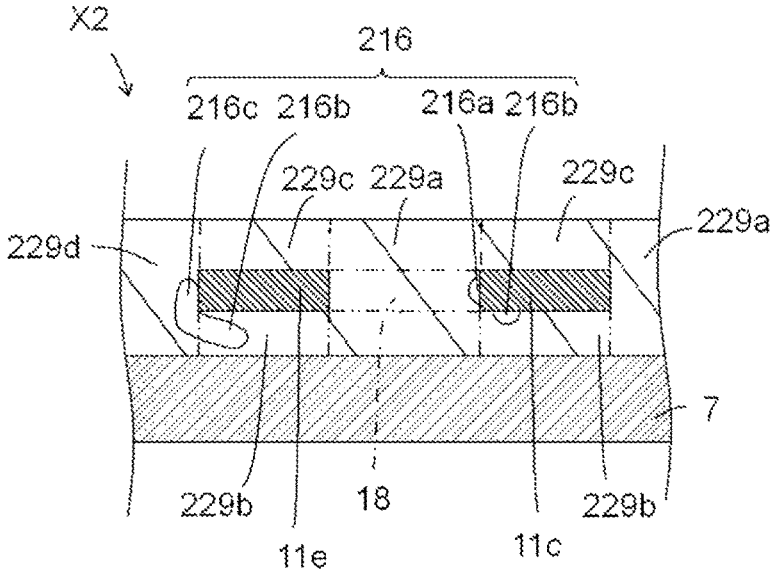

A thermal head X2 will be described with reference to FIGS. 6A and 6B. The same members as those of the thermal head X1 are denoted by the same reference numerals. The same applies below. In the thermal head X2, a cover member 229 is different from the cover member 29 of the thermal head X1. FIG. 6B exemplifies a case in which a first void 216*a* and a second void 216*b* are in contact with the driving IC 11*c* and a case in which the second void 216*b* and a third void 216*c* communicate with each other.

The cover member 229 includes a first portion 229*a*, a second portion 229*b*, a third portion 229*c*, and a fourth portion 229*d*. The first portion 229*a* is a portion extending over each of the inter-driving IC regions 18 between the mutually adjacent driving ICs 11 and extending up and down from each of the inter-driving IC regions, and the first void 216*a* is formed in the first portion 229*a*. The second portion 229*b* is a portion extending below the driving IC 11, and the second void 216*b* is formed in the second portion 229*b*. The third portion 229*c* is a portion extending above the driving IC 11. The fourth portion 229*d* is a portion located on both sides in the main scanning direction of the driving IC 11 group constituted by the plurality of driving ICs 11, and the third void 216*c* is formed in the fourth portion 229*d*. In FIGS. 6A and 6B, boundaries between the first portion 229*a*, the second portion 229*b*, the third portion 229*c*, and the fourth portion 229*d* are indicated by two-dot chain lines. Actually, the first portion 229*a*, the second portion 229*b*, the third portion 229*c*, and the fourth portion 229*d* are continuously provided. For example, the cover member 229 can be continuously manufactured so that a hardening resin is applied astride the plurality of driving ICs 11 by a dispenser.

The first void 216*a* is formed in the first portion 229*a* and is formed in a state of being separated from the head base body 3. The first void 216*a* is formed in a state of being in contact with the driving IC 11*c*. In other words, the first void 216*a* confronts the driving IC 11*c*.

The second void 216*b* is formed in the second portion 229*b* and is formed in a state of being separated from the head base body 3. The second void 216*b* is formed in a state of being in contact with the driving IC 11*c*. In other words, the second void 216*b* confronts the driving IC 11*c*.

The third void 216*c* is formed in the fourth portion 229*d* and is provided on an outer side in the main scanning direction of the driving IC 11 group. The third void 216*c* is formed in a state of being separated from the head base body 3. The third void 216*c* is formed in a state of being in contact with the driving IC 11*e* located at the end in the main scanning direction. In other words, the third void 216*c* confronts the driving IC 11*e*.

As in the first void 216*a*, when the third void 216*c* is formed in a circular shape, the diameter of the third void 216*c* can be set to be 10 to 5000 μm. The first void 216*a*, the second void 216*b*, and the third void 216*c* may not be formed in the circular shape.

Here, when the cover member 229 contracts at the time of cooling after the thermal setting, there is a case where the warpage occurs in the substrate 7 constituting the thermal head X2. When a force is externally applied so as to correct the warpage of the substrate 7 to flatten the substrate 7, there is a concern that the cover member 229 is damaged.

On the other hand, the second void 216*b* is formed in the second portion 229*b* of the cover member 229. Therefore, the contraction in the second portion 229*b* at the time of curing the cover member 229 can be moderated by deforming the second void 216*b*, and thus the warpage of the substrate 7 can be reduced.

Further, even when a force is externally applied to flatten the warped substrate 7, concentration of the compression stress can be moderated by deforming the second void 216*b*, and thus the cover member 229 is less likely to be damaged. Therefore, the sealing property of the driving ICs 11 can be maintained, a failure is less likely to occur in the driving ICs 11.

When the driving ICs 11 are connected to the electrodes by a solder bump, the solder bump may be collapsed at the time of applying compression stress to the cover member 229 externally, and thus there is a concern that the collapsed solder bump is short-circuited with other wirings.

However, the second void 216*b* is formed in the second portion 229*b* of the cover member 229. Therefore, when compression stress is applied from the outside, the second void 216*b* is deformed to reduce the compression stress applied to the solder bump, and thus the solder bump is less likely to be collapsed. As a result, the short-circuiting is less likely to occur in the collapsed solder bump.

The second void 216*b* is in contact with the driving IC 11*c*. In other words, the second void 216*b* confronts the driving IC 11*c*. Thus, thermal conduction to the second portion 229*b* is suppressed. As a result, the heat generated in the driving ICs 11 is less likely to be transferred to the second portion 229*b*, and thus it is possible to suppress thermal expansion of the second portion 229*b*. Therefore, it is possible to prevent the concentration of the compression stress on the second portion 229*b*, and thus the cover member 229 is less likely to be damaged. Thus, the sealing property of the driving ICs 11 can be maintained, and thus a failure is less likely to occur in the driving ICs 11.

The second void 216*b* communicates with the third void 216*c*. Therefore, the second portion 229*b* and the fourth portion 229*d* can be further deformed. As a result, it is possible to suppress concentration of compression stress or tensile stress on the fourth portion 229*d*, and thus the cover member 229 is less likely to be damaged.

Since the second void 216*b* and the third void 216*c* communicate with each other, heat of the heat generating sections located at the ends in the main scanning direction is less likely to be further transferred from the fourth portion 229*d* to the outside. As a result, it is possible to suppress release of heat from the fourth portion 229*d* to the outside, and thus the temperature in the main scanning direction of the thermal head X2 is less likely to be reduced. Therefore, it is possible to reduce a variation in the temperature in the main scanning direction of the thermal head X2.

When the first void 216*a* and the second void 216*b* communicates with each other, the first portion 229*a* and the second portion 229*b* can be further deformed. As a result, it is possible to suppress concentration of compression stress or tensile stress on the first portion 229*a*, and thus the cover member 229 is less likely to be damaged. As a result, the sealing property of the driving ICs 11 can be maintained, and thus a failure is less likely to occur in the driving ICs 11.

Further, the void 216 in which the second void 216*b* and the third void 216*c* communicate with each other has a length in the main scanning direction (hereinafter referred to as a width) in a sectional view, and a lower-side width of the void 216 is larger than an upper-side width thereof. In other words, the widths of the void 216 increase downwards. Thus, it is possible to further reduce the tensile stress applied to the solder bump. The second void 216*b* and the third void 216*c* may not necessarily communicate with each other.

While one embodiment according to the disclosure has been described heretofore, it should be understood that the invention is not limited to the above-described embodiment, and that various modifications and variations are possible without departing from the scope of the invention. For example, although the thermal printer Z1 employing the thermal head X1 according to the first embodiment has been shown herein, it is not intended to be limiting of the invention, and thus, the thermal head X2 may be adopted for use in the thermal printer Z1. Moreover, the thermal heads X1 and X2 according to a plurality of embodiments may be used in combination.

For example, although the thin-film head having the thin heat generating section 9 obtained by forming the electrical resistance layer 15 in thin-film form has been described as exemplification, the invention is not limited to this. The invention may be embodied as a thick-film head having a thick heat generating section 9 by patterning various electrodes and subsequently forming the electrical resistance layer 15 in thick-film form.

Moreover, although a flat-type head in which the heat generating section 9 is formed on the principal surface of the substrate 7 has been described as exemplification, the invention may be embodied as an edge-type head in which the heat generating section 9 is disposed on an end face of the substrate 7.

The heat storage layer 13 may be disposed on the entire region of the upper surface of the substrate 7.

The heat generating section 9 may be configured by forming the common electrode 17 and the discrete electrode 19 on the heat storage layer 13, and thereafter forming the electrical resistance layer 15 only in a region between the common electrode 17 and the discrete electrode 19.

In the specification, an example in which all the driving ICs 11 are covered with the cover member 29 is described, but the invention is not limited to this. The cover member 29 may be provided so as to cover at least two driving ICs, and the other driving ICs 11 may not be integrally covered. Even in this case, when the first void 16*a* is formed in the first portion 29*a* of the cover member 29, it is possible to reduce a possibility that the cover member 29 is damaged.

In the specification, an example in which the first void 16*a* is formed in the first portion 16*a* of the cover member 29 is described, but the invention is not limited to this. At least one void 16 is formed in the cover member 29 or the first void 16*a* may not be necessarily formed in the first portion 29*a*. Even in this case, when the second void 16*b* is formed in the second portion 29*b* of the cover member 29, and the third void 16*c* is formed in the fourth portion 29*d* of the cover member 29, it is possible to reduce a possibility that the cover member 29 is damaged.

FIGS. 4A, 4B, 6A and 6B exemplify a case in which three driving ICs 11 are provided, but the number of driving ICs 11 may be 2 or may be 4 or more.

In FIGS. 4A, 4B, 6A and 6B, an example in which the void 16 is formed in the third portion 29*c* is not described, but the void 16 may be formed in the third portion 29*c*.

REFERENCE SIGNS LIST

X1, X2: Thermal head
Z1: Thermal printer
1: Heat dissipating plate
3: Head base body
7: Substrate
9: Heat generating section
11: Driving IC
13: Heat storage layer
14: Adhesive layer
16, 216: Void
16*a*, 216*a*: First void
16*b*, 216*b*: Second void
16*c*, 216*c*: Third void
29, 229: Cover member
29*a*, 229*a*: First portion
29*b*, 229*b*: Second portion
29*c*, 229*c*: Third portion
29*d*, 229*d*: Fourth portion
31: Connector

The invention claimed is:

1. A thermal head, comprising:

a substrate;

a heat generating section that is disposed on the substrate;

a first driving integrated circuit (IC) and a second driving IC that are disposed on the substrate and electrically coupled to the heat generating section;

a cover member that is disposed above and below the first driving IC and the second driving IC, in an inter-driving IC region between the first driving IC and the second driving IC, and above and below the inter-driving IC region; and a plurality of voids formed in the cover member, wherein the plurality of voids include:

a first void that is located in the inter-driving IC region, and a second void that is located in a first portion disposed below the first driving IC, wherein the first void and the second void communicate with each other.

2. The thermal head according to claim 1, wherein the first void includes a void in contact with the first driving IC.

3. The thermal head according to claim 1, wherein the second void include a void in contact with the first driving IC.

4. A thermal printer, comprising:

the thermal head according to claim 1;

a conveyance mechanism which conveys a recording medium on the heat generating section; and a platen roller which presses the recording medium against a top of the heat generating section.

5. A thermal head, comprising:

a substrate;

a heat generating section that is disposed on the substrate;

a first driving Integrated Circuit (IC) and a second driving IC that are disposed on the substrate and electrically coupled to the heat generating section;

a driving IC group formed from the first driving IC and the second driving IC, wherein the first driving IC and the second driving IC are arranged at predetermined intervals in a main scanning direction, a cover member that is disposed above and below the first driving IC and the second driving IC, in an inter-driving IC region between the first driving IC and the second driving IC, above and below the inter-driving IC region, and at an end in the main scanning direction of the driving IC group; and a plurality of voids formed in the cover member, wherein the plurality of voids include:

a first void located in the inter-driving IC region, a second void located in a first portion disposed below the first driving IC, and a third void located in a second portion disposed in the end of the cover member in the main scanning direction, wherein the second void and the third void communicate with each other.

6. The thermal head according to claim 5, wherein the third void includes a void in contact with the first driving IC.

7. A thermal head, comprising:

a substrate;

a heat generating section that is disposed on the substrate;

a first driving Integrated Circuit (IC) and a second driving IC that are disposed on the substrate and electrically coupled to the heat generating section;

a cover member that is disposed above and below the first driving IC and the second driving IC, in an inter-driving IC region between the first driving IC and the second driving IC, and above and below the inter-driving IC region; and a plurality of voids formed in the cover member, wherein the plurality of voids include:

a first void located in the inter-driving IC region, wherein the cover member further includes a third portion that is disposed above the first-driving IC, and which has no void.

* * * * *